US012404644B2

(12) United States Patent
Sindorf et al.

(10) Patent No.: US 12,404,644 B2
(45) Date of Patent: Sep. 2, 2025

(54) CRASH CUSHION

(71) Applicant: Valtir, LLC, Addison, TX (US)

(72) Inventors: Brent Sindorf, Roseville, CA (US); Michael J. Buehler, Roseville, CA (US)

(73) Assignee: VALTIR, LLC, Addison, TX (US)

( * ) Notice: Subject to any disclaimer, the term of this patent is extended or adjusted under 35 U.S.C. 154(b) by 1221 days.

(21) Appl. No.: 17/188,772

(22) Filed: Mar. 1, 2021

(65) Prior Publication Data

US 2021/0277615 A1 Sep. 9, 2021

Related U.S. Application Data

(60) Provisional application No. 62/987,168, filed on Mar. 9, 2020.

(51) Int. Cl.
*E01F 15/00* (2006.01)
*E01F 15/14* (2006.01)

(52) U.S. Cl.
CPC ..... *E01F 15/148* (2013.01)

(58) Field of Classification Search
None
See application file for complete search history.

(56) References Cited

U.S. PATENT DOCUMENTS 2,088,087 A * 7/1937 Hudson ..... E01F 15/146 256/1
4,190,275 A * 2/1980 Mileti ..... E01F 15/148 293/142
4,399,980 A * 8/1983 van Schie ..... E01F 15/146 188/377
5,011,326 A 4/1991 Carney, III
5,797,592 A * 8/1998 Machado ..... E01F 15/146 404/6
6,179,516 B1 * 1/2001 Ivey ..... E01F 15/146 404/9
6,293,727 B1 9/2001 Albritton
6,427,983 B1 8/2002 Leonhardt et al.
6,461,076 B1 10/2002 Stephens et al.
(Continued)

OTHER PUBLICATIONS

International Search Report and Written Opinion of the International Application No. PCT/US2021/020232, dated May 21, 2021, 18 pp.

*Primary Examiner* — Christopher J Sebesta
*Assistant Examiner* — Katherine J Chu
(74) *Attorney, Agent, or Firm* — Benesch Friedlander Coplan & Aronoff LLP

(57) ABSTRACT

A crash cushion includes a pair of laterally spaced and longitudinally extending rails. A diaphragm frame is moveably supported by the rails. An outer guide is coupled to the diaphragm frame and is configured to engage an outboard portion of the rail on the impact side respectively during a lateral impact. The outer guide on the impact side is releasable from the outboard portion of the rail. A pair of laterally spaced inner guides are coupled to the diaphragm frame and successively engage and release the inboard portion of the impact side and non-impact side of the rails during an impact of sufficient severity. A flexible panel may be coupled to the impact side of the diaphragm frame. A deformable energy absorbing member is moveably connected to a stationary backup.

22 Claims, 16 Drawing Sheets

(56) References Cited

U.S. PATENT DOCUMENTS

| | | | | |
|---|---|---|---|---|
| 6,665,529 | B1 | 12/2003 | Mills, Jr. | |
| 6,863,467 | B2 | 3/2005 | Buehler et al. | |
| 6,905,281 | B2 * | 6/2005 | Kang | E01F 15/146 404/9 |
| 6,962,459 | B2 | 11/2005 | Smith et al. | |
| 7,396,184 | B2 * | 7/2008 | La Turner | E01F 15/146 404/9 |
| 8,016,513 | B2 * | 9/2011 | Shin | E01F 15/146 404/6 |
| RE43,927 | E | 1/2013 | Buehler | |
| 8,469,626 | B2 * | 6/2013 | Thompson | E01F 15/02 404/6 |
| 8,491,216 | B2 * | 7/2013 | Dyke | E01F 15/146 404/6 |
| 8,596,903 | B2 * | 12/2013 | Hur | E01F 15/146 404/6 |
| 8,974,142 | B2 * | 3/2015 | Buehler | E01F 15/08 404/6 |
| 9,725,857 | B2 * | 8/2017 | Cho | E01F 15/0438 |
| 10,676,885 | B2 * | 6/2020 | Baek | E01F 15/0461 |
| 11,377,055 | B2 * | 7/2022 | Buehler | B60R 19/26 |
| 11,453,988 | B2 * | 9/2022 | Lim | E01F 15/0438 |
| 2003/0168650 | A1 | 9/2003 | Alberson et al. | |
| 2004/0016916 | A1 * | 1/2004 | Bronstad | E01F 15/146 256/13.1 |
| 2004/0262588 | A1 * | 12/2004 | Bronstad | E01F 15/146 256/13.1 |
| 2011/0091273 | A1 | 4/2011 | Sayre et al. | |
| 2015/0069771 | A1 * | 3/2015 | Buehler | E01F 15/148 293/118 |
| 2017/0234393 | A1 * | 8/2017 | Degroot | E01F 15/04 256/13.1 |

* cited by examiner

CRASH CUSHION

This application claims the benefit of U.S. Provisional Application No. 62/987,168, filed Mar. 9, 2020 and entitled "Crash Cushion," the entire disclosure of which is hereby incorporated herein by reference.

FIELD OF THE INVENTION

The present invention relates generally to a crash cushion, and in particular, to a crash cushion configured with at least one diaphragm frame supported by a pair of rails.

BACKGROUND

Crash cushions may be used alongside highways in front of obstructions such as concrete walls, toll booths, tunnel entrances, bridges and the like so as to protect the drivers of errant vehicles. Various types of crash cushions may be configured with a plurality of energy absorbing elements, such as an array of resilient, self-restoring tubes, which facilitate the ability to reuse the crash cushion after an impact. The tubes may be exposed, as configured for example in the REACT 350® impact attenuator manufactured by Energy Absorption Systems, Inc., or disposed within bays defined by a plurality of diaphragms and fender panels extending alongside the diaphragms, as shown for example in the QUADGUARD® Elite crash cushion, also manufactured by Energy Absorption Systems, Inc. In these types of systems, the tubes may be made of high density polyethylene.

It may be desirable to make such systems self-restoring, such that the system has the capacity to withstand additional impacts should they occur before the system is inspected and maintained. Concurrently, it is desirable to minimize the amount of damage suffered by such systems during impact, such that the systems may be easily restored and/or repaired.

SUMMARY

The present invention is defined by the following claims, and nothing in this section should be considered to be a limitation on those claims.

In one aspect, one embodiment of a crash cushion includes first and second laterally spaced and longitudinally extending rails. A diaphragm frame has first and second laterally spaced sides, wherein the diaphragm frame is moveably supported by the first and second rails in a longitudinal direction. First and second laterally spaced outer guides are coupled to the diaphragm frame, with each of the first and second outer guides configured to engage an outboard portion of the first and second rails respectively during a lateral impact of the crash cushion on a first or second side of the crash cushion respectively. Each of the first and second outer guides is releasable from the outboard portions of the first and second rails, and in one embodiment from the diaphragm frames, in response to a first load configuration applied to one of the first or second sides of the crash cushion respectively. First and second laterally spaced inner guides are coupled to the diaphragm frame. The first and second inner guides are spaced laterally inboard from the first and second outer guides respectively, wherein the first inner guide is configured to engage an inboard portion of the first rail during the lateral impact of the crash cushion on the first side of the crash cushion after release of the first outer guide. The first inner guide is releasable from the inboard side of the first rail, and in one embodiment from the diaphragm, in response to a second load configuration applied to the first side of the crash cushion. The second inner guide is configured to engage an inboard portion of the second rail during the lateral impact of the crash cushion on the first side of the crash cushion after release of the first inner guide. The second inner guide is releasable from the inboard side of the second rail, and in one embodiment from the diaphragm, in response to a third load configuration applied to the first side of the crash cushion.

In another aspect, one embodiment of the crash cushion includes a pair of laterally spaced and longitudinally extending rails, each of the rails including inboard and outboard overhangs extending laterally inboard and outboard respectively from each of the rails. A diaphragm frame includes laterally spaced sides, an upstream face and a downstream face, wherein the diaphragm frame is moveably supported by the rails, and wherein the diaphragm frame is moveable along the rails in a longitudinal direction. An energy absorbing member is coupled to the downstream face of the diaphragm frame. In one embodiment, an energy absorbing member is also coupled to the upstream face of the diaphragm. A pair of laterally spaced outer guides are coupled to the diaphragm frame. Each of the outer guides includes an engagement portion underlying the outboard overhang of one of the rails. A pair of laterally spaced inner guides are coupled to the diaphragm frame. Each of the inner guides includes an engagement portion underlying the inboard overhang of one of the rails.

In another aspect, one embodiment of a crash cushion includes a diaphragm frame having laterally spaced sides, an upstream face and a downstream face. A pair of energy absorbing members are coupled to the upstream and downstream faces of the diaphragm frame. A flexible panel is coupled to one of the sides of the diaphragm frame, wherein the flexible panel extends laterally outwardly from the side of the diaphragm frame and is deformable in a longitudinal direction. In one embodiment, a pair of flexible panels are coupled to opposite sides of the diaphragm frame.

In another aspect, one embodiment of a crash cushion includes a deformable energy absorbing member and a stationary backup, wherein the energy absorbing member is moveably connected to the backup. The energy absorbing member is laterally moveable relative to the backup.

In another aspect, one embodiment of a method of attenuating energy when impacting a crash cushion includes laterally impacting a side of one or more energy absorbing members with a vehicle, wherein the one or more energy absorbing members are coupled to a diaphragm frame supported by first and second laterally spaced and longitudinally extending rails, transferring an impact load to the diaphragm frame from the one or more energy absorbing members, engaging an outboard portion of the first rail with a first outer guide coupled to the diaphragm frame, releasing the first rail from the first outer guide in response to a first load configuration applied to the side of the one or more energy absorbing members when laterally impacting the side of the one or more energy absorbing members, engaging an inboard portion of the first rail with a first inner guide spaced laterally inboard from the first outer guide and coupled to the diaphragm frame, releasing the first rail from the first inner guide in response to a second load configuration applied to the side of the one or more energy absorbing members when laterally impacting the side of the one or more energy absorbing members, engaging an inboard portion of the second rail with a second inner guide spaced laterally from the first inner guide and coupled to the diaphragm frame, and releasing the second rail from the second inner guide in response to a third load configuration applied to the side of the one or more energy absorbing members when laterally impacting the side of the one or more energy absorbing members.

In yet another aspect, one embodiment of a method of attenuating energy when impacting a crash cushion includes laterally impacting a pair of energy absorbing members with a vehicle, wherein the pair of energy absorbing members are coupled to upstream and downstream faces of a diaphragm frame, impacting a flexible panel coupled to and extending laterally outwardly from a side of the diaphragm frame between the pair of energy absorbing members, and deflecting the flexible panel in a longitudinal direction.

In yet another aspect, one embodiment of a method of attenuating energy when impacting a crash cushion includes laterally impacting a deformable energy absorbing member with a vehicle, wherein the energy absorbing member is coupled to a stationary backup with a connector, moving the connector laterally relative to the stationary backup, and moving the energy absorbing member laterally relative to the stationary backup.

The various embodiments of the crash cushion, and the methods for the use and assembly thereof, provide significant advantages over other crash cushions. For example and without limitation, the various crash cushion embodiments utilize features that improve the performance thereof and increase the reusability of the crash cushion after impact. The progressive and sequential failure of the outer and inner guides coupled to the diaphragm frame minimizes the damage to the underlying rails, making the system refurbishment easier. The crash cushion maximizes redirective strength while minimizing damage to the system base track, or rails. The successive failure points depend on the severity of the side impact, thereby minimizing the damage to the rails and amount of labor and parts needed to refurbish the system.

The backup connection also provides advantages, for example and without limitation by helping to redirect an impacting vehicle while minimizing the forces applied acting on the impacting vehicle.

The flexible panels also provide advantages by helping to redirect a vehicle away from the gap located between two adjacent cylinders, and by minimizing the amount the cables pocket into the gap.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
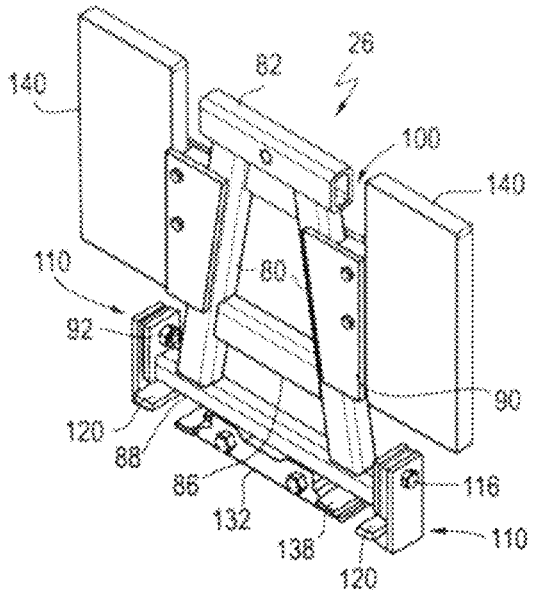
FIG. 1 is a perspective view of one embodiment of a diaphragm frame.
Figure 2:
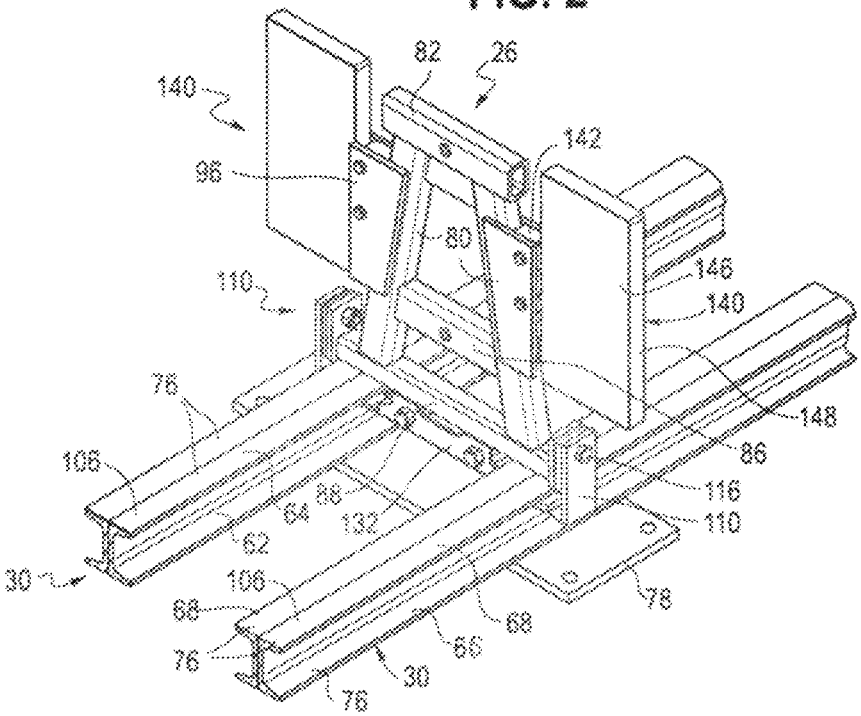
FIG. 2 is a perspective view of the diaphragm frame shown in FIG. 1 applied to a pair of rails (partially shown).
Figure 3:
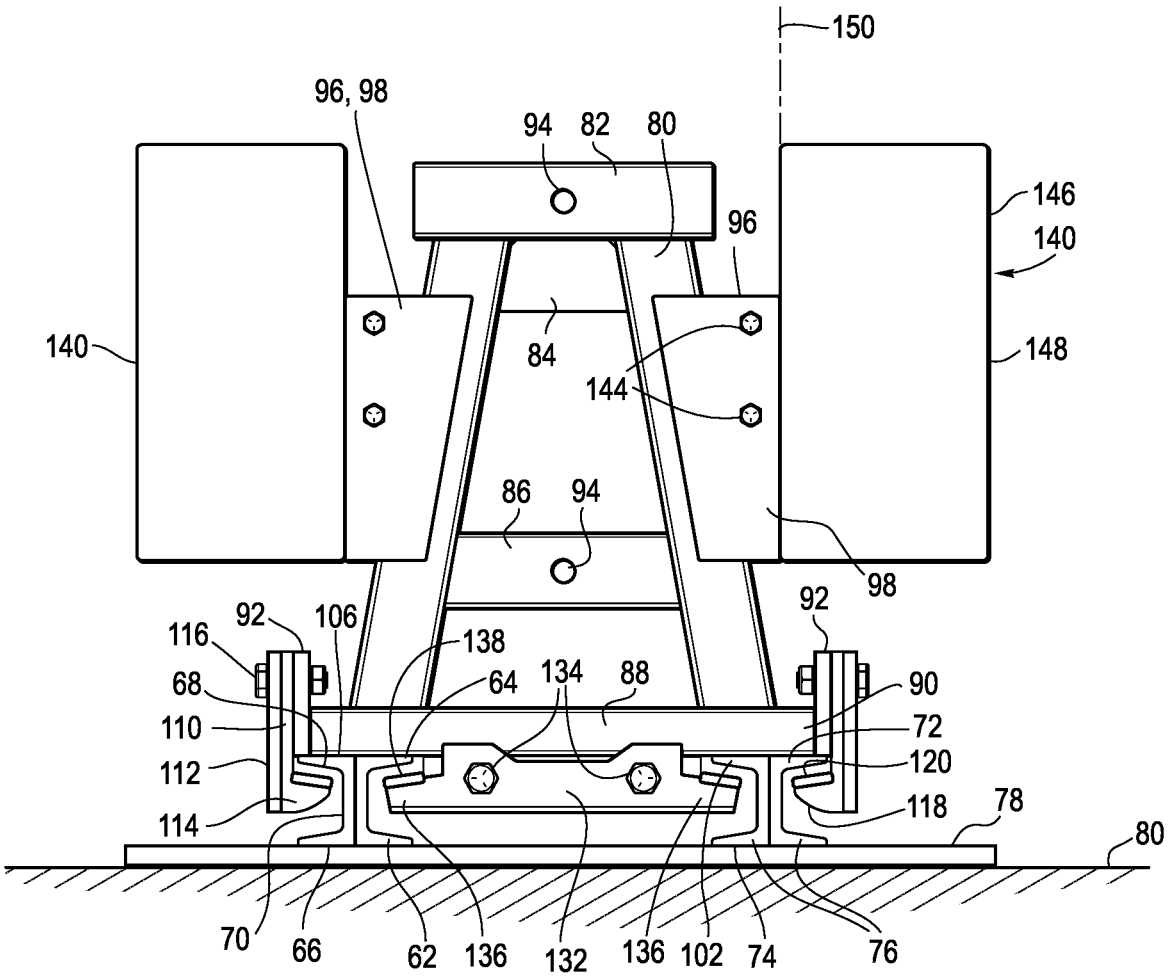
FIG. 3 is an end view of the diaphragm frame shown in FIG. 1 applied to a pair of rails.

It should be understood that the term "plurality," as used herein, means two or more. The term "longitudinal," as used herein means of or relating to length or the lengthwise direction 2 of the crash cushion, or assembly thereof, and includes an axial, end-on impact direction. During an end-on impact, the system dissipates the energy of the impacting vehicle as the cylinders collapse. The term "lateral." as used herein, means directed between or toward (or perpendicular to) the side of the crash cushion, for example the lateral direction 4, or a side impact direction. The term "coupled" means connected to or engaged with, whether directly or indirectly, for example with an intervening member, and does not require the engagement to be fixed or permanent, although it may be fixed or permanent, and may include an integral connection wherein the features being coupled are portions of a single, unitary component. The term "transverse" means extending across an axis, and/or substantially perpendicular to an axis. It should be understood that the use of numerical terms "first," "second," "third," etc., as used herein does not refer to any particular sequence or order of components; for example "first" and "second" connector segments may refer to any sequence of such segments, and is not limited to the first and second connector segments of a particular configuration unless otherwise specified. The terms "upstream" and "downstream" refer to directions relative to the impact direction of a vehicle, for example with the backstop and rear anchor being downstream of the front anchor, or front of the crash cushion. The terms "inboard" and "outboard" are defined in the lateral direction relative to a centerline longitudinal axis 16, with "inboard" referring to a component or feature being closer to the centerline axis, and "outboard" referring to a component or feature being further from the centerline axis.

Energy Absorbing Members

As can be seen in FIGS. 19-22, a crash cushion 10 has a plurality of energy absorbing members 12 arranged in a longitudinal array 14 extending along the longitudinal axis 16. In one embodiment the energy absorbing members 12 are configured as high density polyethylene (HDPE) tubes (configured as cylinders) of varying thicknesses positioned along the longitudinal axis 16 extending in a longitudinal direction 2. In other embodiments, the energy absorbing members may be configured in other ways, including various crushable materials, such as foam cartridges. The tubes may be resilient, self-restoring tubes each having a center axis 18 and an interior surface 20. It should be understood that the term "tubes" refers to a hollow, elongated structure, and may be configured in different shapes, including without limitation the disclosed cylindrical shape. Thicker cylinders may be placed at the rear of the system to provide impact capacity for large vehicles, whereas thinner cylinders may be placed at the front of the system to provide a soft initial impact force for smaller vehicles. Adjacent tubes 12 are disposed on opposite sides of a diaphragm frame 26 and abut downstream/upstream faces 22, 24 of the diaphragm frame. The tubes are coupled to the diaphragm frame 26 and each other with a pair of vertically spaced and longitudinally extending fasteners 28.

The tubes 12 and diaphragm frames 26 are supported by and coupled to track, configured as a pair of laterally spaced rails 30 at the base of the system in one embodiment. In this embodiment, the tubes are oriented with the center axis 18 extending in a vertical direction. The interface between the tubes 12 or cylinders and the rails 30 provides a redirective capability to vehicles that laterally impact the side of the system. In addition, a plurality of vertically spaced cables 32 are provided along each side of the system, with upstream first ends 34 of the cables coupled to a front anchor 36 and downstream second ends 38 of the cables coupled to a backstop 40, with the cables providing additional redirective capabilities.

During an end-on impact by a vehicle 42, the tubes 12 collapse along the longitudinal axis 16, with the diaphragm frames 26 compressing the energy absorbing members or tubes 12, safely bringing the vehicle to a stop. During a side, or lateral, impact by the vehicle 42, the cables, flexible panels and tubes safely redirect the vehicle, while transferring the load to the diaphragm frames and then to the ground mounted rails. It should be understood that the term "lateral" impact or load refers to any load vector 44 having a lateral component 48, wherein the load is applied to the side of the crash cushion, regardless of whether the load vector 44 also includes a longitudinal component 46.

Figure 22:
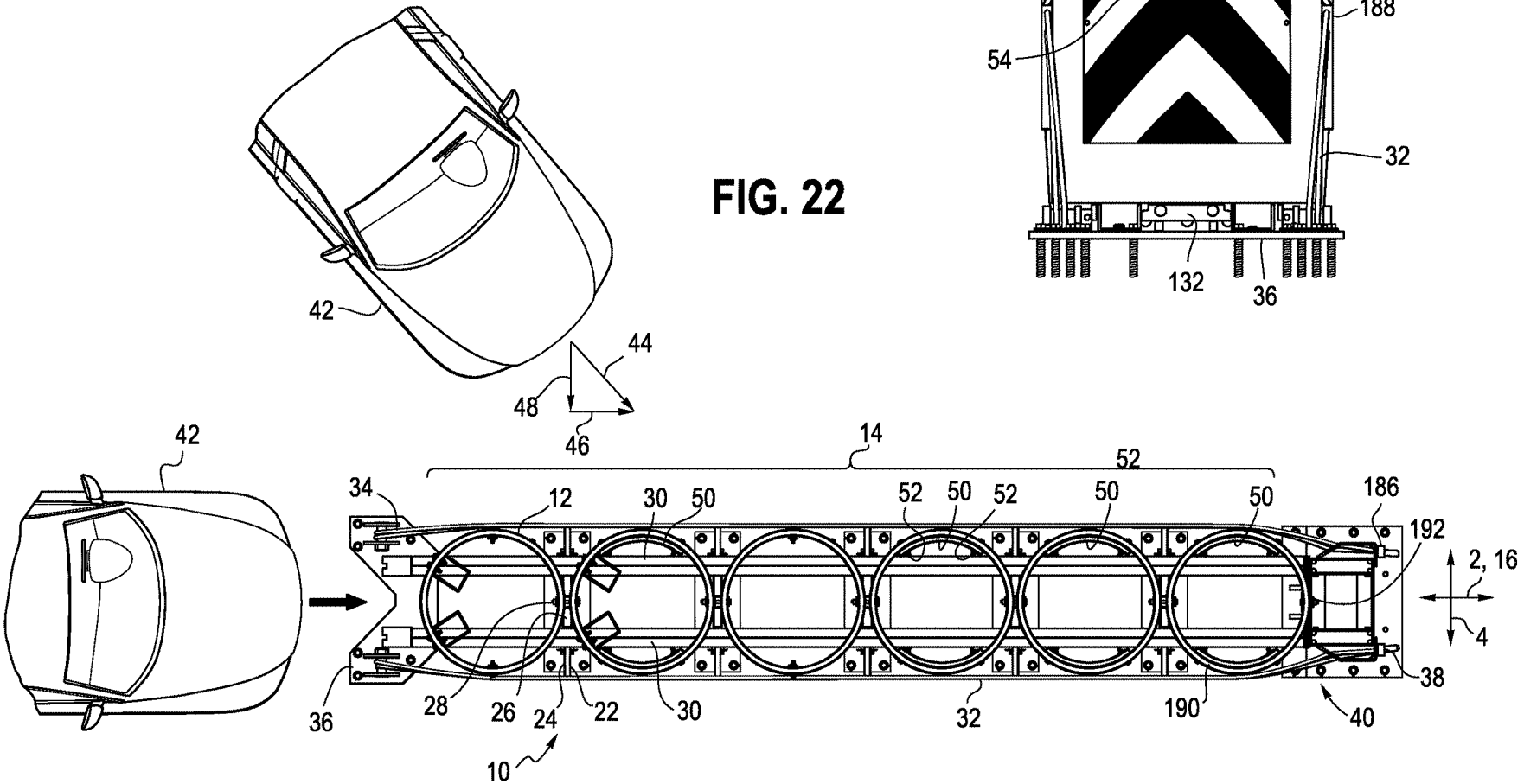
FIG. 22 is a top view of one embodiment of a crash cushion.
Figure 23:
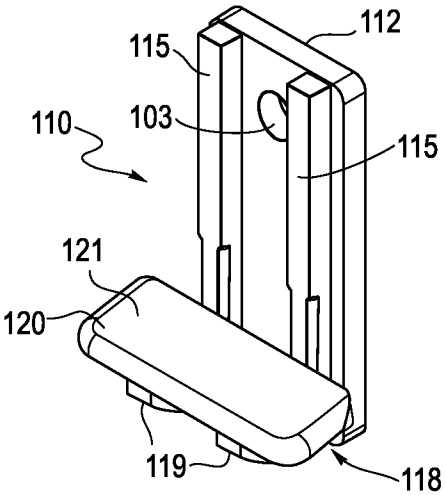
FIG. 23 is a perspective view of one embodiment of an outer guide.
Figure 26:
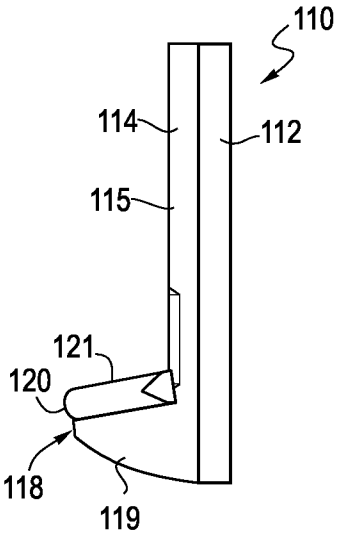
FIG. 26 is an end view of the outer guide shown in FIG. 23.
Figure 24:
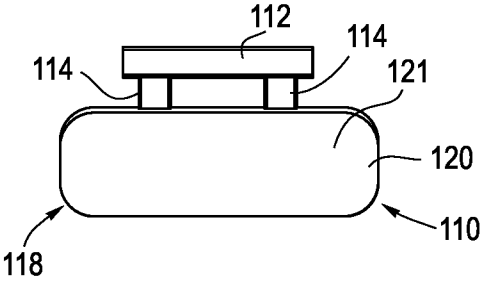
FIG. 24 is a top view of the outer guide shown in FIG. 23.
Figure 25:
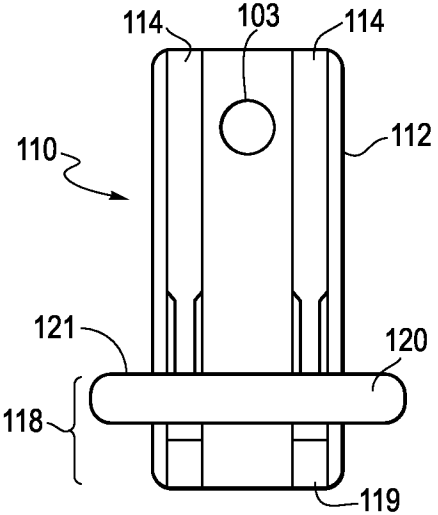
FIG. 25 is an inboard side view of the outer guide shown in FIG. 23.
Figure 27:
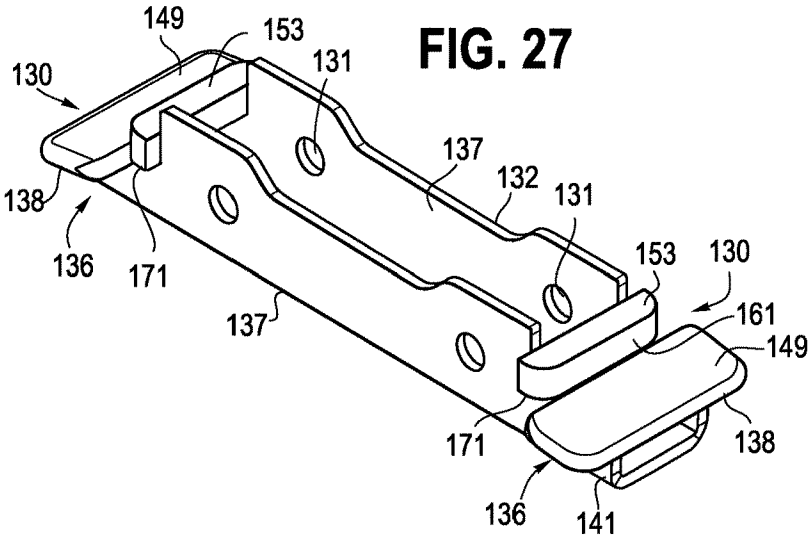
FIG. 27 is a perspective view of one embodiment a bracket defining a pair of inner guides.
Figure 28:
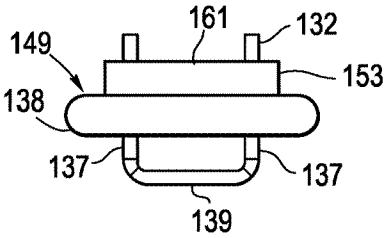
FIG. 28 is an outboard side view of the bracket and inner guide shown in FIG. 27.
Figure 29:
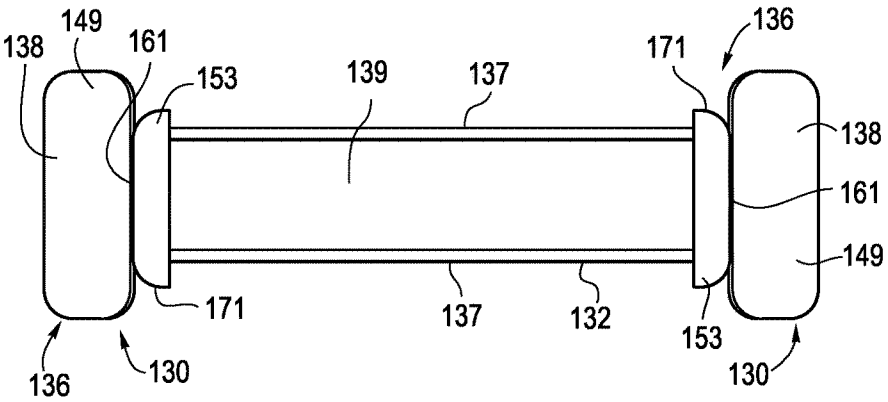
FIG. 29 is a top view of the bracket and inner guides shown in FIG. 27.
Figure 30:
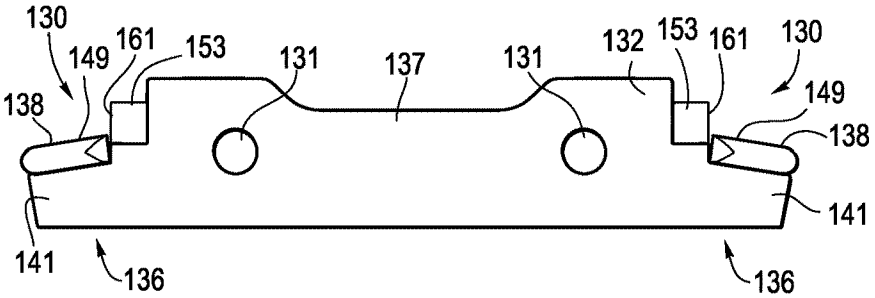
FIG. 30 is an end view of the bracket and inner guides shown in FIG. 27.

In one embodiment, segments 50 are incorporated into one or more of the tubes 12, including for example the second, fourth, fifth and sixth tubes (numbered downstream from the front end of the system), by securing the segments interiorly to the tubes with a plurality of fasteners. In one embodiment, the segments 50 in the second tube are 1.4 inches thick by 24 inches in circumferential length by 36 inches in height, while the segments in the fourth, fifth and sixth tubes are 1.0 inches thick by 24 inches in circumferential length by 48 inches in height. In one embodiment, the first two tubes have a thickness of about 1 inch, while the last four tubes have a thickness of about 1.4 inches. Referring to FIG. 22, the HDPE segments 50 are disposed along an interior surface 20 of the tube 12, with the interior of the tube being open, or free of any reinforcing structure, between opposing segments such that the tube 12 and segments 50 may freely and fully collapse during an impact. In other embodiments, supplementary energy absorbing or redirective components, such as compressible struts, may be disposed in the interior of the tube. In one embodiment, the segments are held in place by a plurality of fasteners, for example hex head bolts 52, washers and nuts. One suitable embodiment provides for ½ inch×4 inch bolts. Alternatively, other mounting devices such as rivets, screws, adhesives/bonding agents, plastic welding, and etc. could be used to secure the segments to the tubes. In one embodiment, the pairs of segments 50 are coupled to the tube 12 on opposite sides of the interior surface 20. The opposing segments 50 intersect a diametral plane containing the center axis 18 of the tube 12 and which lies substantially perpendicular to the longitudinal axis 16. The diametral plane defines the bend line of the tubes during a head-on axial impact. The segments may be centered along a height of the tube, may have the same height as the tube, or may be offset so as to be closer to the bottom of the tube, or have a bottom edge coincident with the bottom edge of the tube. The horizontal centerlines of the segments may be positioned below a center of gravity (CG) of a large vehicle, but above the CG of a small vehicle, which minimizes the likelihood of an errant vehicle from vaulting or diving. A reflective coating 54 or member may be disposed over the front of the first tube.

During an impact event, the energy absorbing members, or tubes 2, collapse, thereby absorbing energy. In an axial impact, the portion of the tube intersected by the diametral plane, and configured with segments 50 or end portions undergoes the most deformation, straining the HDPE material at this location. The segments 50 increase the energy absorption of the tube assembly, without the expense of increasing the thickness of an entirety of the primary tube.

Although reference is made herein to the tubes and segments being made of HDPE, it should be understood that other polymeric and rubber compounds, such as rubber or other plastics, may be used for the energy absorbing tubes and/or segments. Using different materials may affect the amount of energy absorbed, the shape of the force deflection curve, the peak force, and the ability of the cylinder assemblies to completely restore after an impact. The number, size, and location of fasteners securing the segments to the tubes may also affect the stiffness of the segments and hence the amount of energy they absorb. For example, moving the existing bolts inwardly towards the diametral plane 54 may have the effect of shortening the effective length of the segments, thereby increasing the stiffness of the cylinder and increasing the total amount of energy absorbed. Including additional rows of bolts, or universal/continuous attachment such as with an adhesive, may have the affect of shortening the effective length, while also causing the cylinder/segment assembly to act more like a thicker walled cylinder, which may also increase the stiffness of the cylinder and the amount of energy absorbed thereby.

Track

Referring to FIGS. 1-12, 15 and 18-22, the track is configured with the pair (e.g., first and second) rails 30, which are laterally spaced and extend longitudinally on opposite sides of the longitudinal axis 16. The rails each have an inboard portion configured with an inboard foot 62 and an inboard overhang 64 vertically spaced above the foot and extending laterally inboard from the rail. The rails also include an outboard portion having an outboard foot 66 and an outboard overhang 68 vertically spaced above the foot and extending from the rail laterally outboard. The rails may be configured as I-beams having a vertical web 70 and upper and lower flanges 72, 74 defining the feet and overhang portions. In one embodiment, the rails are defined by a pair of C-channels 76 arranged back-to-back, with abutting webs and flanges extending laterally inboard and outboard respectively. The channels may be connected to define the rail. The rails, whether integrally formed as an I-beam, or formed by a pair of C-channels, may be made of steel. The rails are fixed to a plurality of longitudinally spaced base plates 78, which are anchored to the ground 80, for example with spikes or other fasteners. The rails may be made of steel in one embodiment.

Diaphragm Frame

Referring to FIGS. 1-12, 15 and 18-22, each diaphragm frame 26 has an A-frame structure, with a pair of side posts 80 angled inwardly, a top cross member 82 coupled to the upper ends of the posts, a web 84 extending between the side posts, an intermediate cross member 86 extending between and connected to intermediate portions of the side posts, and a bottom cross member 88 extending between and connected to the lower ends of the posts. The bottom cross member has end portions 90 extending outwardly from the posts. A pair of mounting plates 92 are connected to the ends of the bottom cross member, for example by welding, and extend vertically therealong. The cross members may be tubular components, made for example of metal, including steel. The upper and intermediate cross members 82, 86 have central holes 94 aligned with and positioned to receive the fasteners 28 securing the tubes 12 thereto as they abut the upstream and downstream faces 24, 22. A pair of side supports 96 are coupled to the outboard side of each side post 80. The side supports may include a pair of longitudinally spaced plates 98 coupled to each of the posts, for example by welding, with a gap or space 100 defined thereby. A bottom surface 102 of the bottom cross member, as well as the bottom edge 104 or surface of the tubes, bears against the top surface 106 of the rails, and may move or slide therealong in the longitudinal direction 2, for example during a longitudinal impact such that one or more diaphragm frames 26 are moveably supported by the first and second rails 30 in the longitudinal direction. It should be understood that in different impact scenarios, some of the diaphragms (e.g., at the upstream end), may move during an impact, but others (e.g., near the downstream end), may not move, while in other scenarios, all of the tubes may compress and all diaphragms are moved along the rails.

Referring to FIGS. 1-12 and 23-26, a pair (first and second) of laterally spaced outer or outboard guides 110 are coupled to the diaphragm frame. In one embodiment, the outer guides each include an outer (vertically oriented) plate 112 and a pair of inner supports 114, each having a vertical leg or rib 115. The inner supports, or ribs, contribute to (increase) the overall bending strength of the outer guide 110, for example about a horizontal axis proximate the fastener opening 113. The plate 112 and supports 114 are coupled to one of the mounting plates 92 with a laterally extending fastener 116, which is disposed above the lower cross member and extends through opening 113. Each support 114 includes a foot 119, extending laterally inboard from the leg or rib and underlying the outboard overhang 68. The foot may have an enlarged profile to increase the bending and shear strength thereof. An engagement portion 118 includes the feet 119 and a rub pad 120, or platform, which extends longitudinally across a top surface of the feet 119, and may be coupled (e.g., by welding) to the top of the feet 119 under the outer, or outboard overhang 68. The support 114, including the engagement portions 118, prevents the outer guide from rotating about the axis of the fastener 116 as it abuts the overhang 68 of the rail. In an initial at-rest position, the top surface of the engagement portion 118, defined by a top surface 121 of the rub pad, is vertically spaced below the lower surface of the outboard overhang 68 such that a gap is defined therebetween. The outer or outboard guide on the non-impact side also helps maintain a connection between the diaphragm and the track during a head-on impact. It should be understood that in other embodiments the outer guide(s) may each be made as a single, integral component, for example an L-shaped bracket having an engagement portion underlying the outer portion of the rail.

Referring to FIGS. 1-12 and 27-30, a pair (first and second) of laterally spaced inner or inboard guides 130 are coupled to the diaphragm frame 26. In one embodiment, the inner guides are laterally spaced inboard from corresponding ones of the outer or outboard guides. The pair of guides 130 may be defined by portions of a single, integral component, or may be configured as separate components, which are individually attached to the diaphragm. In one embodiment, the pair of inner guides are defined by opposite ends of a bracket 132, which is coupled to the lower cross member, for example with a pair of longitudinally extending and laterally spaced fasteners 134, which extend through openings 131. The bracket is defined in one embodiment as an upwardly opening channel having longitudinally spaced flanges 137 and a bottom web 139. The inner guides include deformable engagement portions 136 extending laterally outwardly or outboard from laterally spaced opposite ends of the bracket, and underlying the inboard overhangs 64 extending inboard from the first and second rails respectively. The engagement portions 136 are defined by C-shaped end portions 141 supporting a rub pad 138, which extends longitudinally across and is coupled to the top edges of the flanges defining the end portions 141 under the overhang 64. The end portions 141 define a first shoulder, which in turn includes a corner that facilitates the deformation or failure as explained below. In an initial at-rest position, the top surface 149 of the rub pad 138, or platform portion of the engagement portion, is vertically spaced below the lower surface of the overhang 64 such that a gap is defined therebetween.

Each inner guide 130 includes a secondary rub pad 153, which extends longitudinally and is supported on a second shoulder defined by each flange 137, with the pair of shoulders on each flange defining a pair of steps in the flanges 137. The secondary rub pads 153 have a vertical surface 161 facing laterally outboard that may engage the inboard portion of the rails, e.g., the inner side surface of the inboard overhang. Longitudinally spaced ends 171 of the rub pads 153 are each curved such that rub pads 153 do not bind on the rails.

Figure 19:
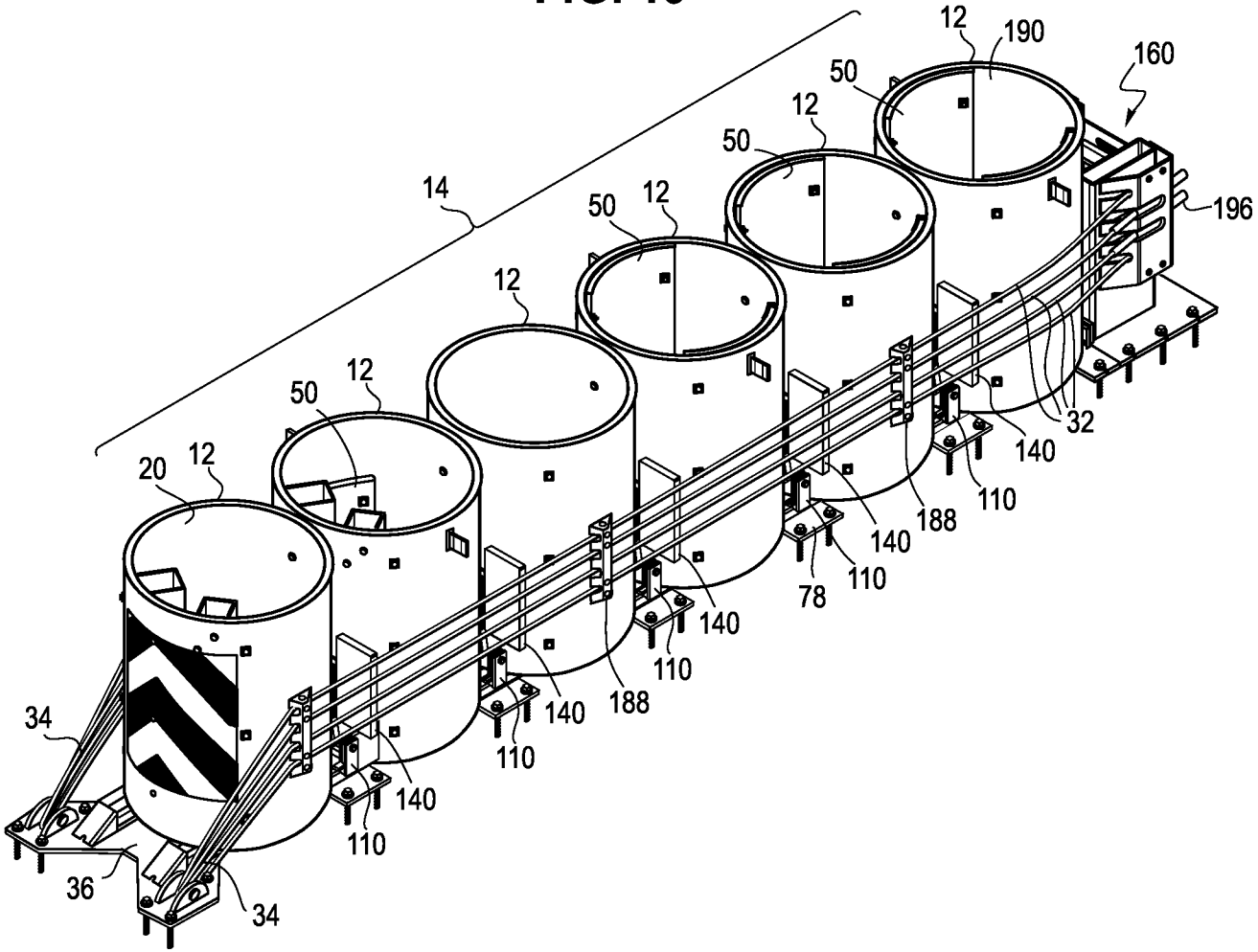
FIG. 19 is a perspective view of one embodiment of a crash cushion.
Figure 20:
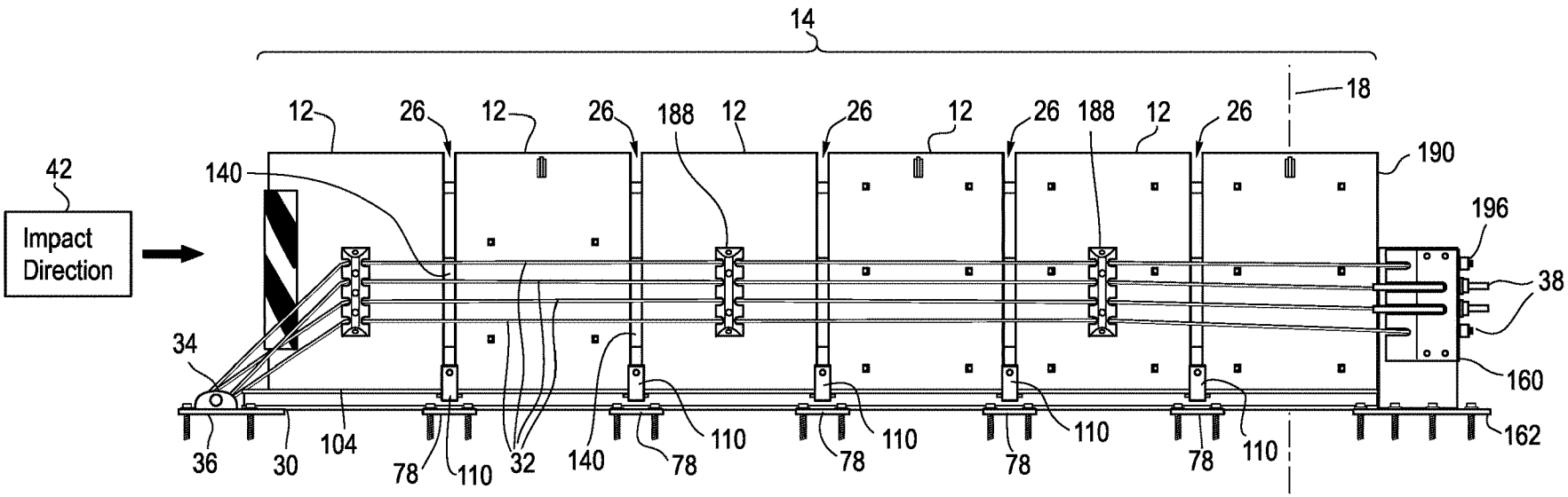
FIG. 20 is a side view of one embodiment of a crash cushion.
Figure 21:
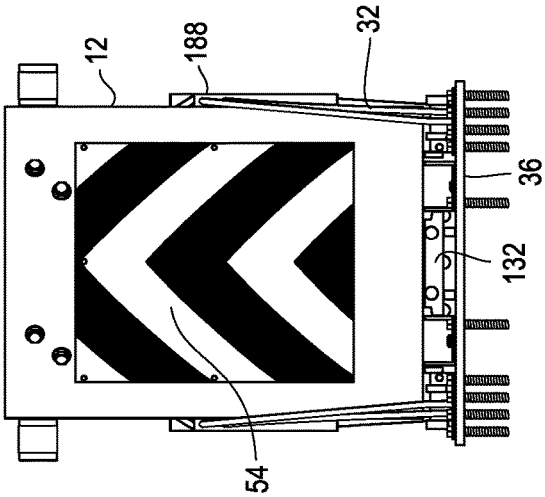
FIG. 21 is a front end view of one embodiment of a crash cushion.

Each of the diaphragm frames is disposed between an adjacent pair of tubes, which abut the downstream and upstream faces of the diaphragm frame. As shown in FIGS. 19, 20 and 22, the forwardmost, or first, upstream tube, does not have a diaphragm frame positioned in front thereof, such that the tube is impacted directly by a vehicle during an axial, head-on impact (see FIG. 20). In this embodiment, having a plurality "n" (shown as n=6) of tubes, a second plurality "n−1" (shown as n−1=6−1=5) of diaphragm frames is incorporated into the system. It should be understood that in other embodiments, there may be different ratios of tubes to diaphragms, including greater or less than the disclosed 6:5 ratio, for example 1:1. For example, there may be a 2:1 ratio of tubes to diaphragms. In other embodiments, there may be more than one tube coupled to each face of the diaphragm. Or tubes spaced in the longitudinal direction may be directly coupled to each other without an intervening diaphragm.

Flexible Panels

First and second flexible panels 140 are coupled to the first and second sides of the diaphragm frame respectively. Each panel includes an insert portion 142 disposed in the gap 100 between the plates 98, with the insert portion being secured to the side supports with a pair of fasteners 144. The panel includes a flexible portion 146 that extends laterally outwardly from the side supports and terminates at a free edge 148. In one embodiment, the flexible portion is rectangular and has a vertical free edge. As shown in FIGS. 19 and 20, the flexible panel 140, or flexible portion 146 thereof, has a height sufficient that it extends along the sides of the plurality of the cable array, and can abut the cables and prevent them from pocketing. At the same time, the panel has a lesser height than the adjacent tubes, and has a bottom edge spaced above the rails and bottom edge of the tubes, and a top edge spaced below the top edge of the tubes. For example, in one exemplary embodiment, the panel has an 18 inch height, has a top edge spaced 21.5 inches below the top of the tube, and has a bottom edge spaced 8.5 inches above the bottom edge of the tube. As shown in FIG. 22, the flexible portion 146 is disposed between the first and second deformable cylinders disposed on either side of the diaphragm frame and abutting the downstream/upstream faces thereof. The flexible panels 140 are deformable in the longitudinal direction 2, for example by bending about a vertical axis, which may be located proximate a hinge line 150 defined by the interface with the side supports and insert portion.

Backup

Referring to FIGS. 13-20 and 22, a stationary backup 160 includes a base plate 162 secured to the ground with spikes or other fasteners and defines a rear anchor. The backup includes a pair of laterally spaced posts 164 extending upwardly from the base plate and a plurality of cross members 166, 168 extending between the posts, which may be configured as tubes and made of metal, such as steel. The front cross members 168 each includes laterally, or horizontally, extending slots 170. The cross members may have tubular, L and/or C shaped cross section. A bottom plate 172 extends laterally between the posts 164.

A pair of side anchor brackets 174 are coupled to the outboard sides of the posts. The anchor brackets each include a front deflector plate 176 that angles outwardly and rearwardly, a side plate 178 that extends longitudinally and a rear plate 180. The front, side and rear plates may be formed integrally. One or more webs 184 may be secured between the brackets and the posts. A plurality of longitudinally, horizontally, extending and vertically spaced slots 182 are defined in each of the brackets. The cables 32 extend through the slots 182, and openings in the rear plate, and are secured to the rear plate with fasteners, such as nuts 186.

Cable guides 188, configured as vertically extending brackets, may be secured to the sides of one or more tubes, with the guides defining through openings to support and maintain the vertical spacing of the plurality of cables 32, shown as four. It should be understood that more or less cables may be used.

The rearwardmost, or most downstream tube 190, is coupled to the backup with a plurality of vertically spaced non-clamping fasteners 192, for example bolts and nuts with washers, extending through openings in the tube and the plurality of slots 182. A strap 193, or vertically elongated washer, runs along the interior of the tube 190 to prevent pull-out of the fasteners 192. The fasteners 192, because they do not clamp the tube 190 to the backup, may slide laterally in the slots 182 during an impact (as shown for example in FIGS. 16 and 17), but are centered in the slots in an at-rest, non-impact configuration.

Operation:

During an axial impact along the longitudinal axis 16, the tubes 12 compress in the longitudinal direction 2 as they are compressed between the diaphragm frames 26, with the tubes 12 dissipating energy. The cables 32 maintain the tubes in alignment and anchor the system.

Figure 10:
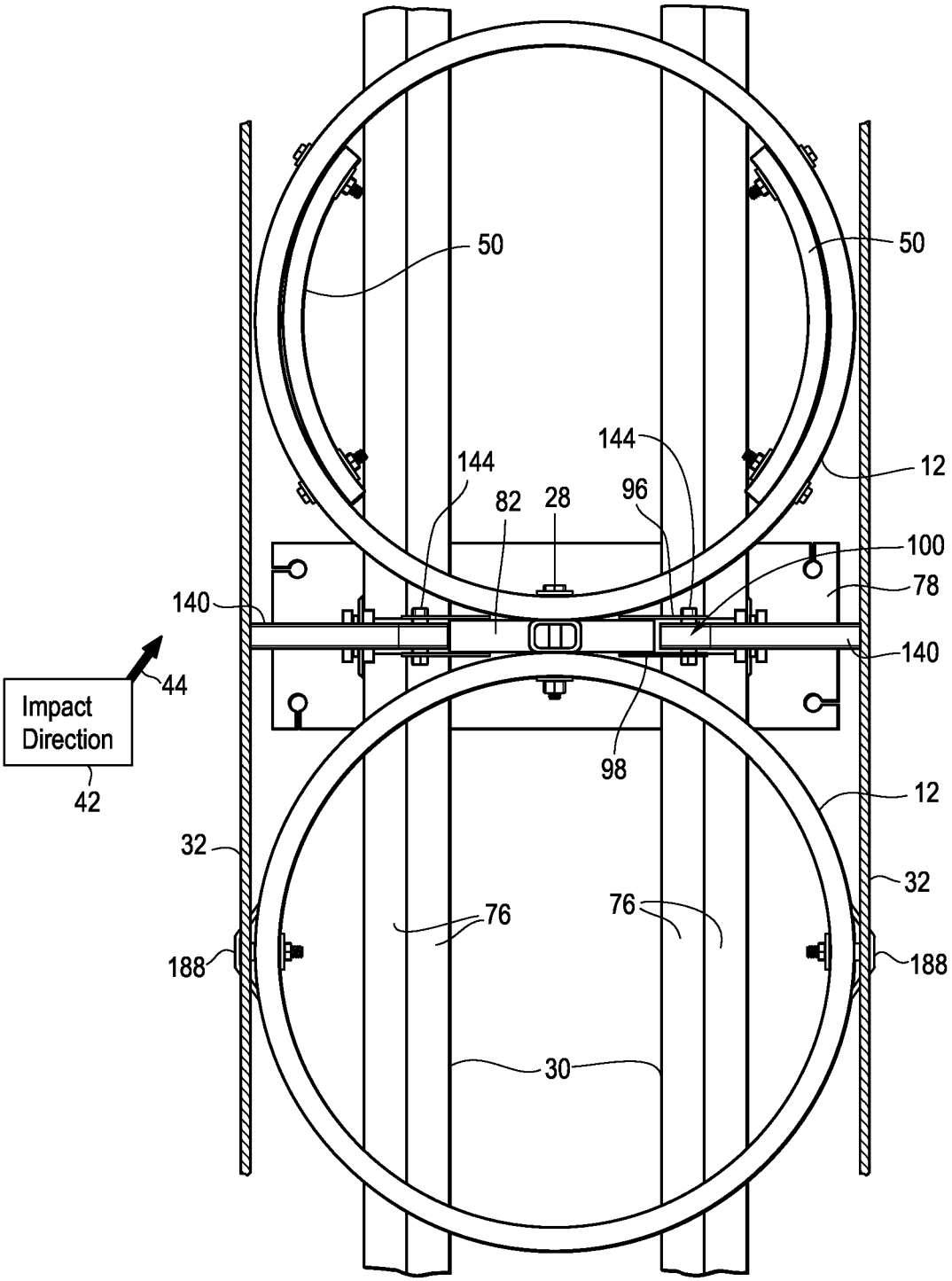
FIG. 10 is a partial top view of the crash cushion showing a diaphragm with a pair of adjacent energy absorbing members coupled thereto in an initial state just prior to a lateral impact.
Figure 11:
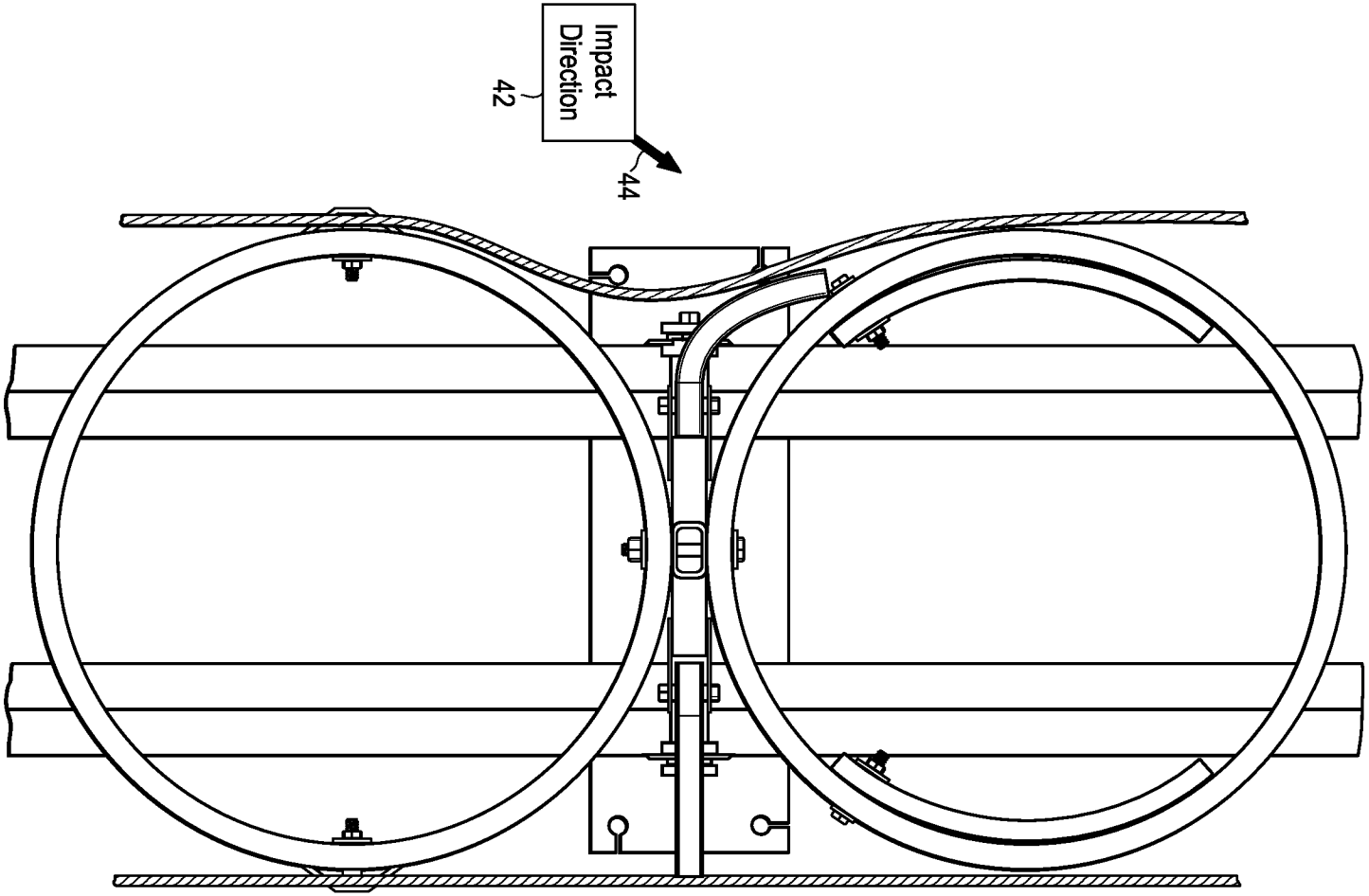
FIG. 11 is a partial top view of the crash cushion showing a diaphragm with a pair of adjacent energy absorbing members coupled thereto during a lateral impact.
Figure 12:
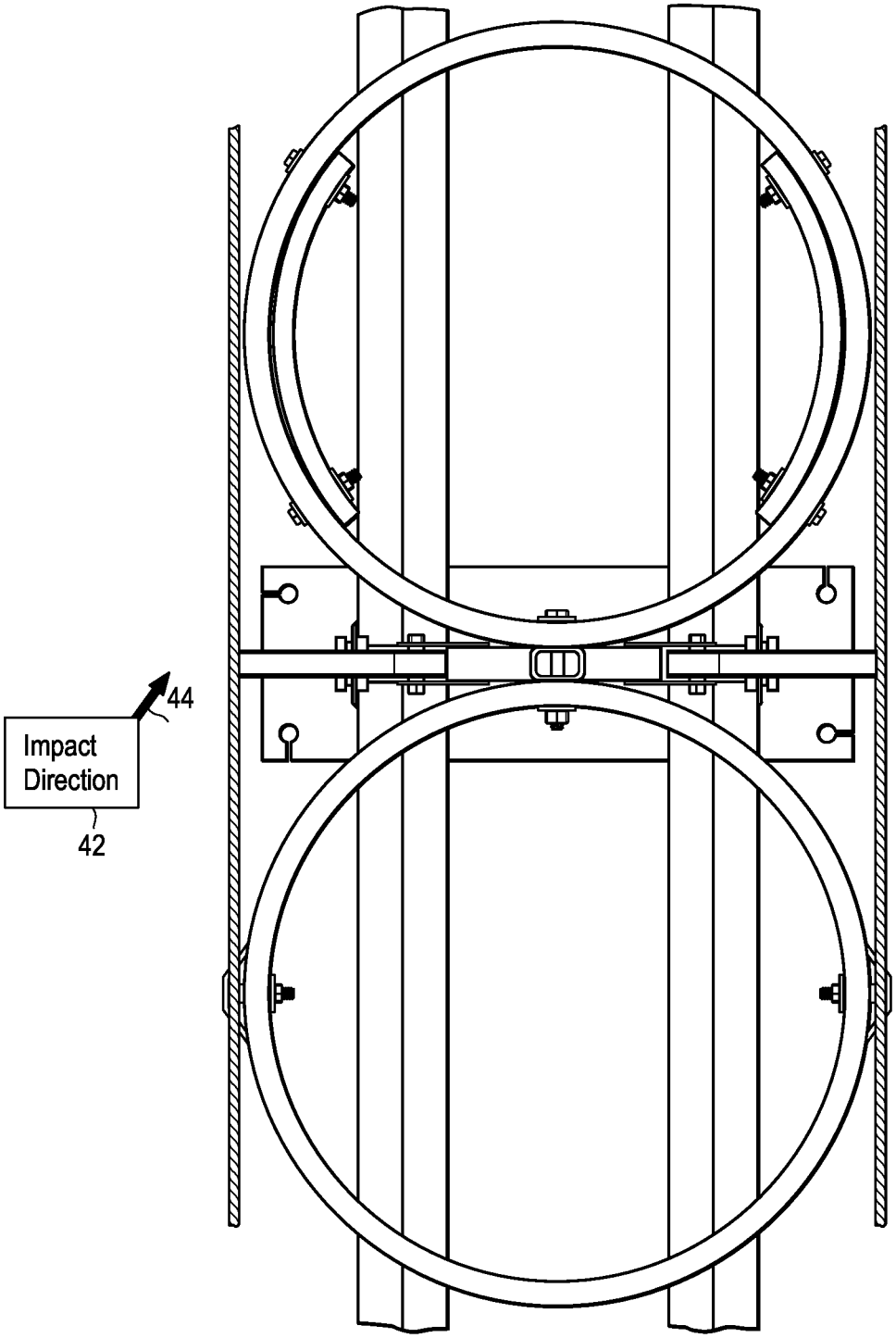
FIG. 12 is a partial top view of the crash cushion showing a diaphragm with a pair of adjacent energy absorbing members coupled thereto after a lateral impact.
Figure 13:
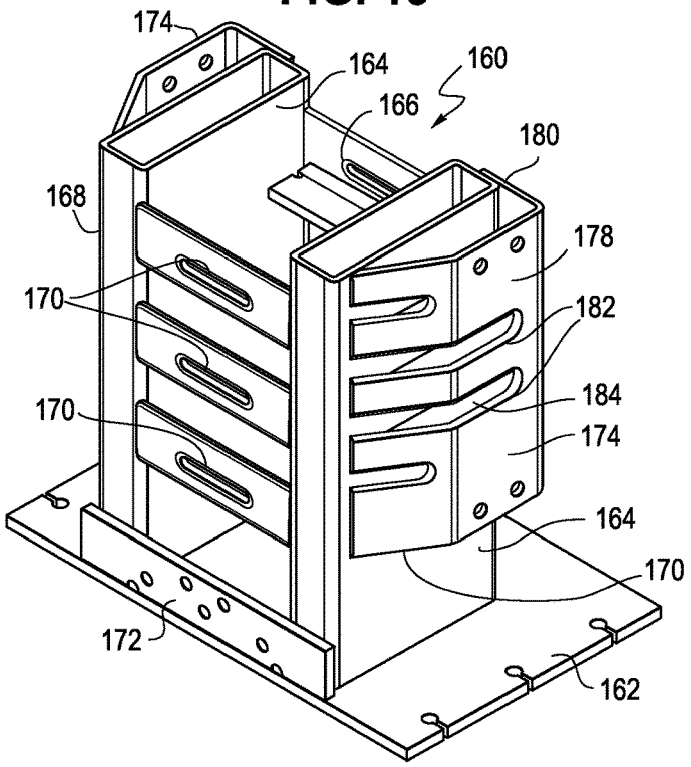
FIG. 13 is a perspective view of a backup.
Figure 14:
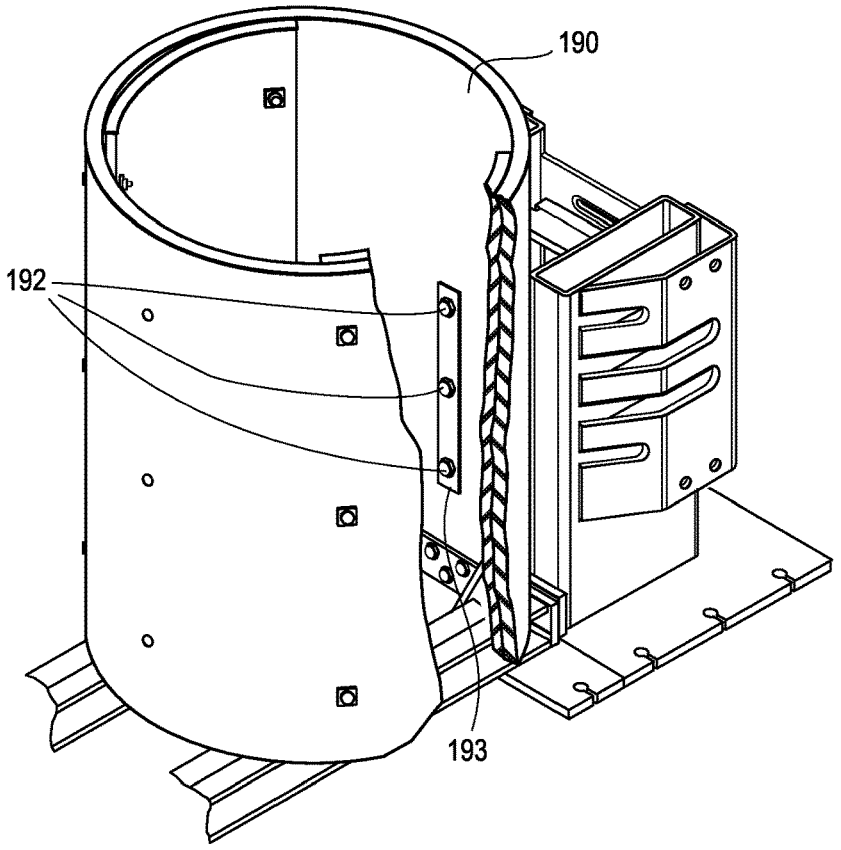
FIG. 14 is a partial perspective view of the backup with an energy absorbing member coupled thereto.
Figure 15:
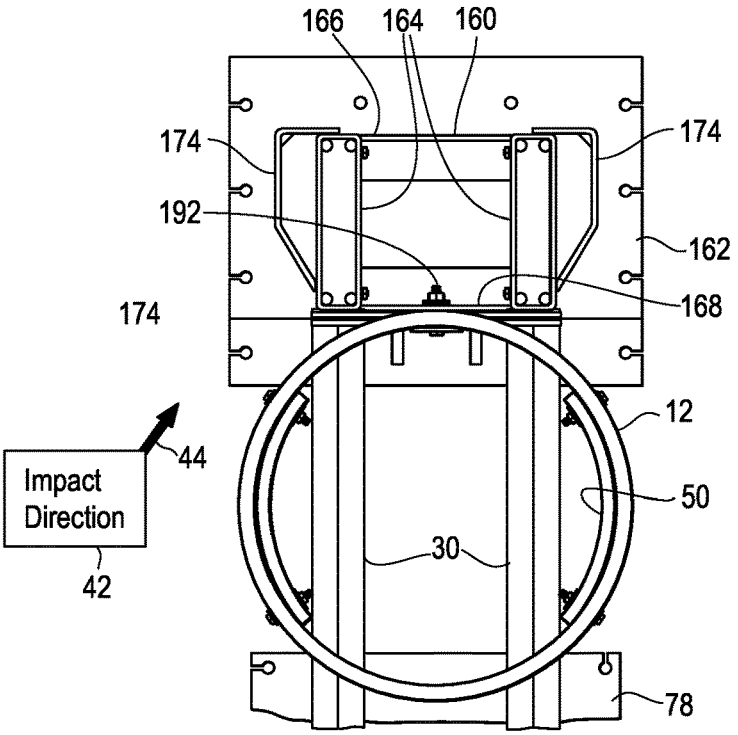
FIG. 15 is a top view of the energy absorbing member and backup shown in FIG. 14 prior to a lateral impact.
Figure 16:
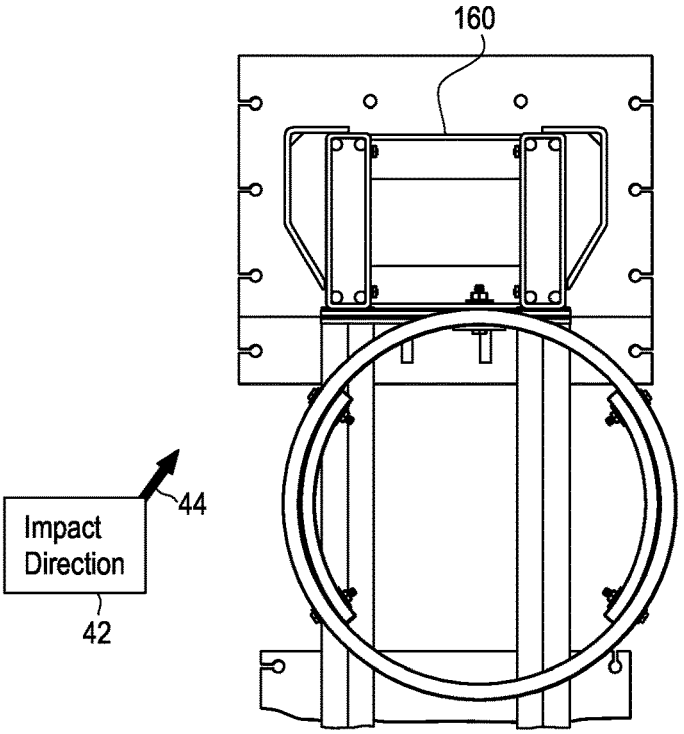
FIG. 16 is a top view of the energy absorbing member and backup shown in FIG. 14 during a lateral impact.
Figure 17:
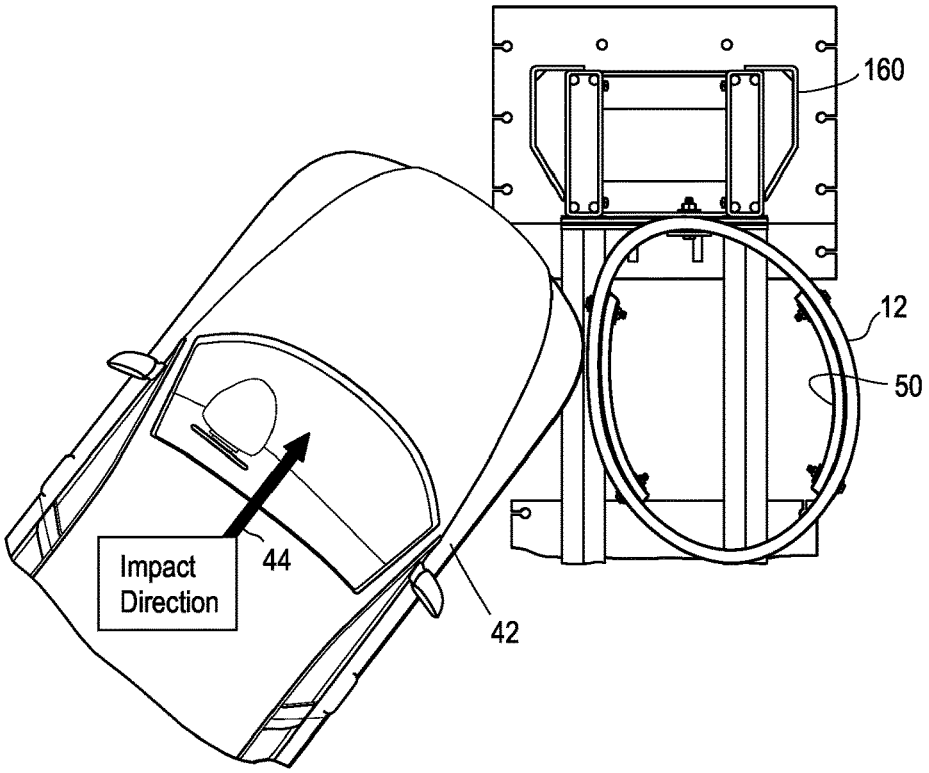
FIG. 17 is a top view of the energy absorbing member and backup shown in FIG. 14 during a lateral impact.
Figure 18:
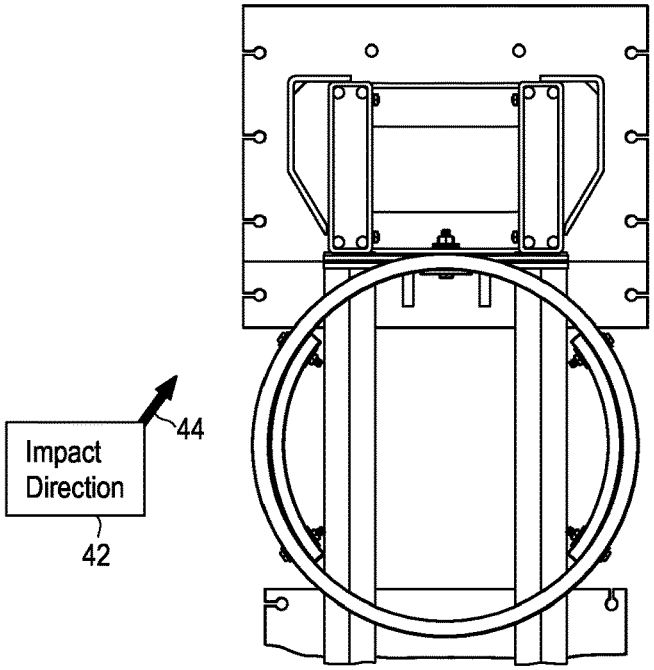
FIG. 18 is a top view of the energy absorbing member and backup shown in FIG. 14 after a lateral impact.

During a lateral impact along one or both of the first and second sides of the crash cushion, meaning at least a portion 48 of the impact vector 44 extends laterally, while another portion of the impact vector may be longitudinal, the impacting vehicle 42 strikes one or more of the tubes 12 and cables 32 and compresses the tubes while deflecting the flexible panel 140 in the longitudinal direction, for example by bending. Referring to FIGS. 10-12, the flexible panels 140, which extend laterally and are disposed between adjacent tubes, act to redirect the impacting vehicle away from the gap located between the tubes. The panels 140 hinge or bend away from the impacting vehicle while filling the gap between adjacent tubes. The panels 140 minimize the amount the cables 32 pocket into the gap between adjacent tubes, further minimizing the interaction of the vehicle 42 with the tubes. After the impacting vehicle passes over the gap, as shown in FIG. 12, the panel 140 may return to its initial resting position. Therefore, in one embodiment, a method of attenuating energy when impacting a crash cushion includes laterally impacting a pair of energy absorbing members 12 with a vehicle, wherein the pair of energy absorbing members are coupled to upstream and downstream faces of a diaphragm frame 26, impacting a flexible panel 140 coupled to and extending laterally outwardly from a side of the diaphragm frame between the pair of energy absorbing members, and deflecting the flexible panel in a longitudinal direction 2.

Figure 4:
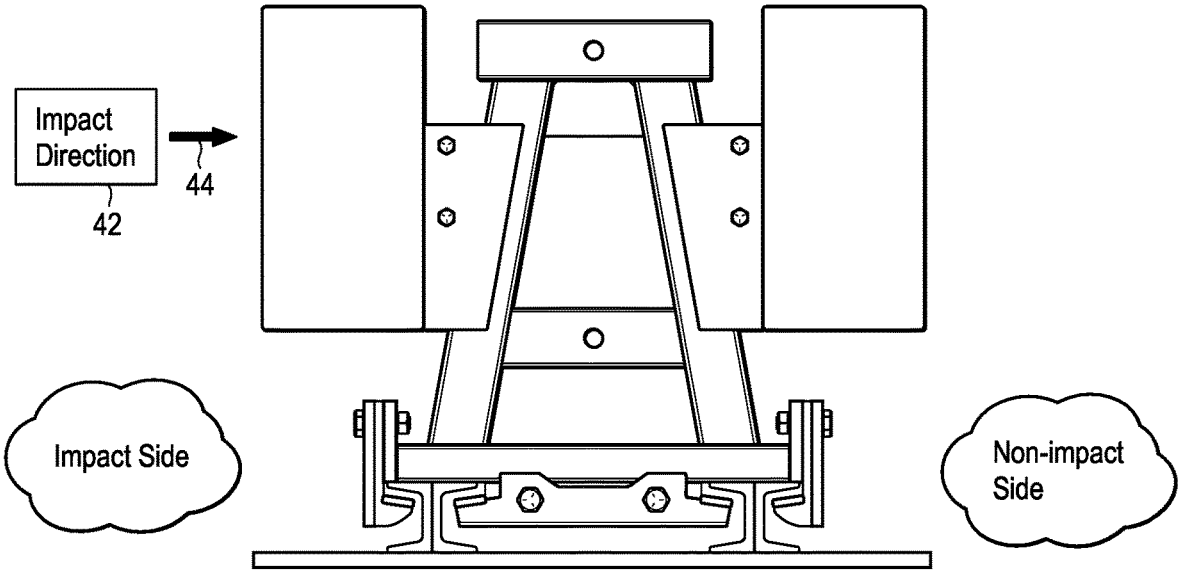
FIG. 4 is an end view of the diaphragm frame shown in FIG. 1 applied to a pair of rails in an initial state just prior to a lateral impact.
Figure 5:
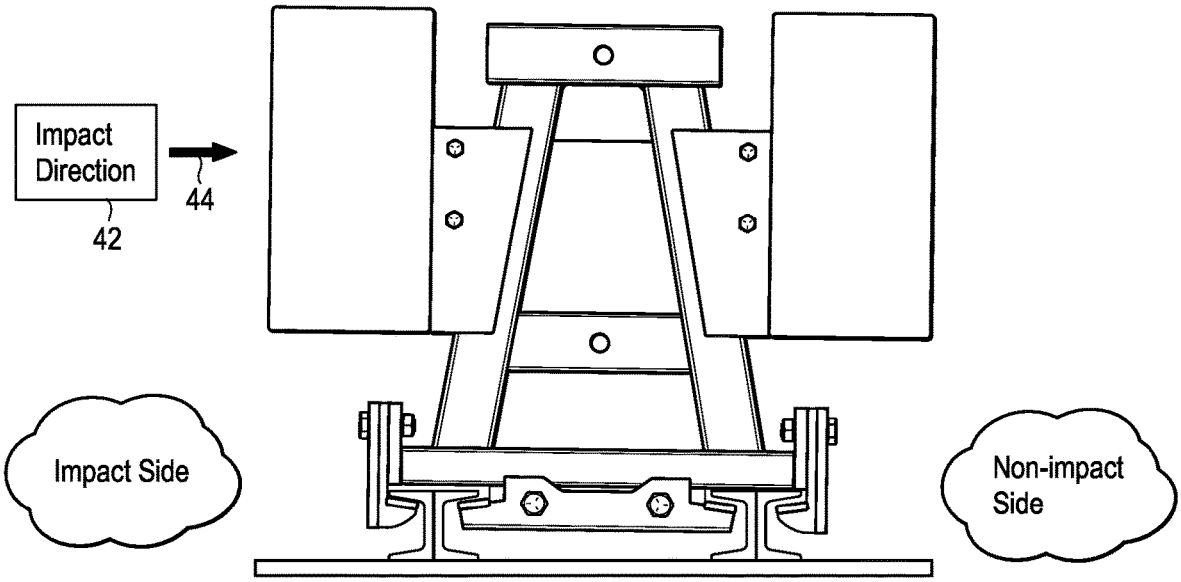
FIG. 5 is an end view of the diaphragm frame shown in FIG. 1 applied to a pair of rails during a lateral impact applying less than a first load configuration to the side of the crash cushion.

During the lateral impact into the side of the crash cushion, the diaphragm frames 26 act to redirect the vehicle away from the system/hazard as shown in FIGS. 4-8. The diaphragm is in an initial resting position as shown in FIG. 4.

During the lateral impact of the vehicle 42 into the side of the crash cushion, including impacting the cables 32 and the outer surfaces of the tubes 12, the tubes and flexible panel 140 on the impact side transfer the impact load to one or more diaphragm frames 26 via the connectors 28 (e.g., fasteners). As the diaphragm frame 26 rocks, or starts to rotate about a longitudinal axis (not necessarily the centerline axis 16), the outer guide 110 on the impact side, and in particular the engagement portion thereof including the rub pad, engages the outboard portion of the rail on the impact side, and in particular the overhang 68 thereof. The impact side outer guide 110 is releasable from the outboard portion of the rail, and in one embodiment from the diaphragm frame, and in particular the mounting plate, if a predetermined load is exceeded. For example, the fastener 116 may be configured to fail, by way of pull-out from one or both of the outer guide or mounting plate, tensile or shear failure, and/or the outer guide may deform, such that the outer guide 110 is released from the outboard portion of the rail and/or the diaphragm frame 26 at a predetermined first load configuration applied to the impact side of the crash cushion. Alternatively, and without fastener release, the outer guide 110 may deform, e.g., bend or fracture, such that the outer guide releases from the outboard portion of the rail in response to the first load configuration. It should be understood that the same failure mechanism may be provided on both sides of the crash cushion, for example if it is exposed to traffic on both sides, or may be used on left and right hand installations such that the traffic is directed along one or both sides of the crash cushion.

Figure 6:
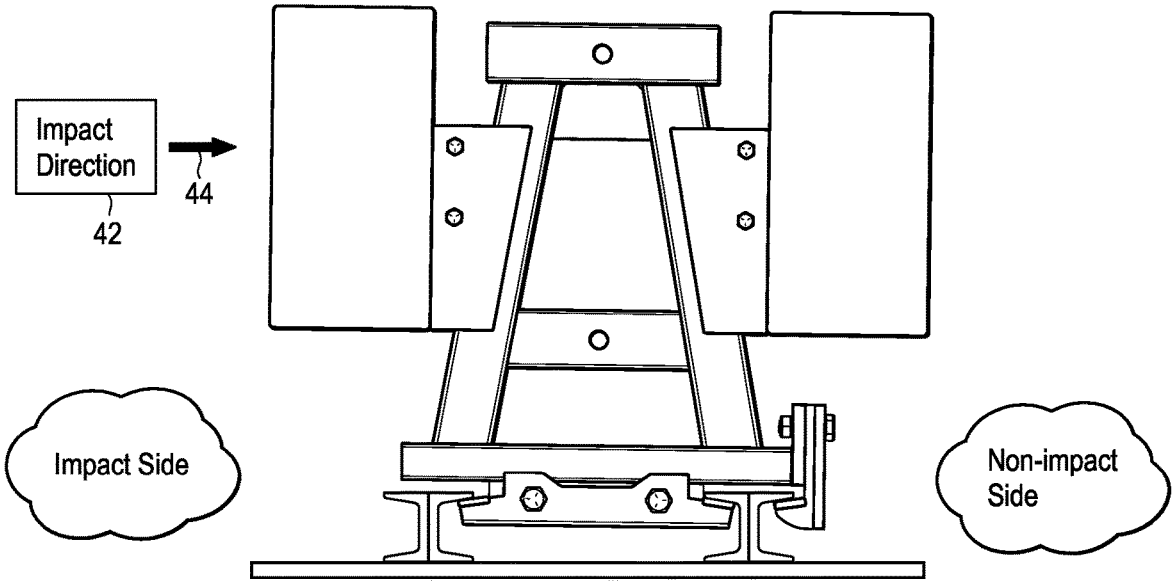
FIG. 6 is an end view of the diaphragm frame shown in FIG. 1 applied to a pair of rails during a lateral impact applying more than a first load configuration but less than a second load configuration to the side of the crash cushion.
Figure 7:
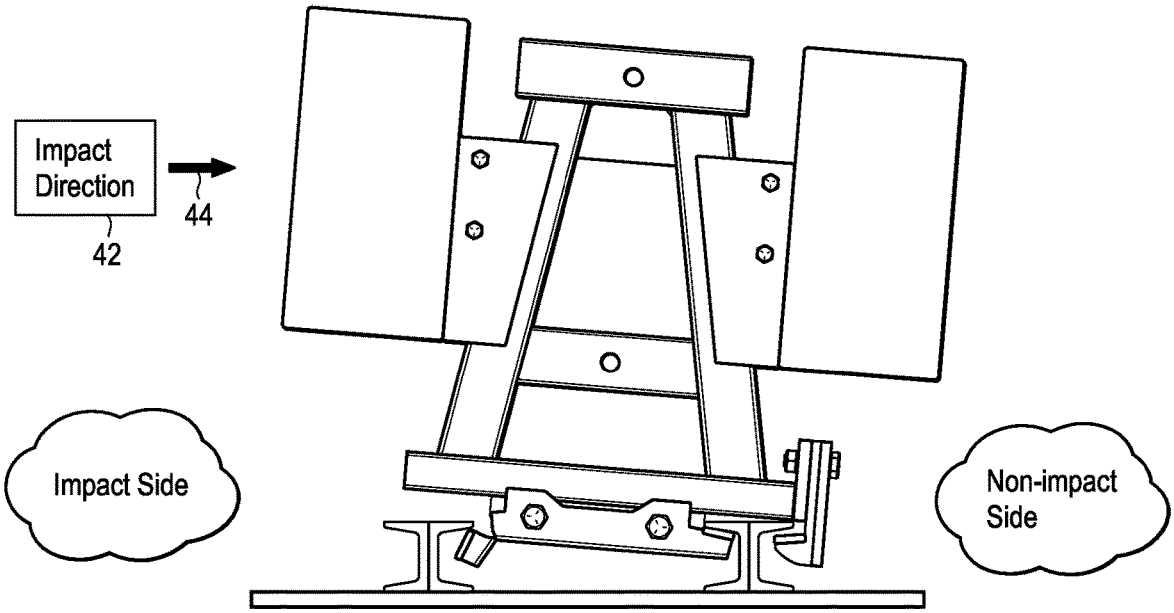
FIG. 7 is an end view of the diaphragm frame shown in FIG. 1 applied to a pair of rails during a lateral impact applying more than a second load configuration but less than a third load configuration to the side of the crash cushion.

As the outer guide fastener 116 releases the outer guide 110, or the outer guide fails by deformation and releases the rail, on the impact side of the crash cushion, the inner guide 130, and in particular the engagement portion including the rub pad 138, on the impact side makes contact with the inboard portion of the rail on the impact side as shown in FIG. 6, and in particular the inboard overhang 64. If the impact exceeds a second level of severity, for example when a second load configuration is applied to the impact side of the crash cushion, the inner rail guide 130, and in particular the end portions 141 on the impact side may deform, for example by bending or fracture initiated at the corner of the shoulder in each flange, thereby releasing from the inner portion of the impact side rail and resulting in additional rotation of the diaphragm frame 26 and allowing the inner guide 130 on the non-impact side to make contact with the inboard portion of the rail on the non-impact side, and in particular the inboard overhang 64 on the non-impact side, as shown in FIG. 7. The inner rail guide may be completely severed or separated from the diaphragm, or may merely deform such that the inner portion of the rail is released. It should be understood that the inner guide 130 may also be configured to release upon failure of one or more fasteners securing the inner guide to the diaphragm.

Figure 8:
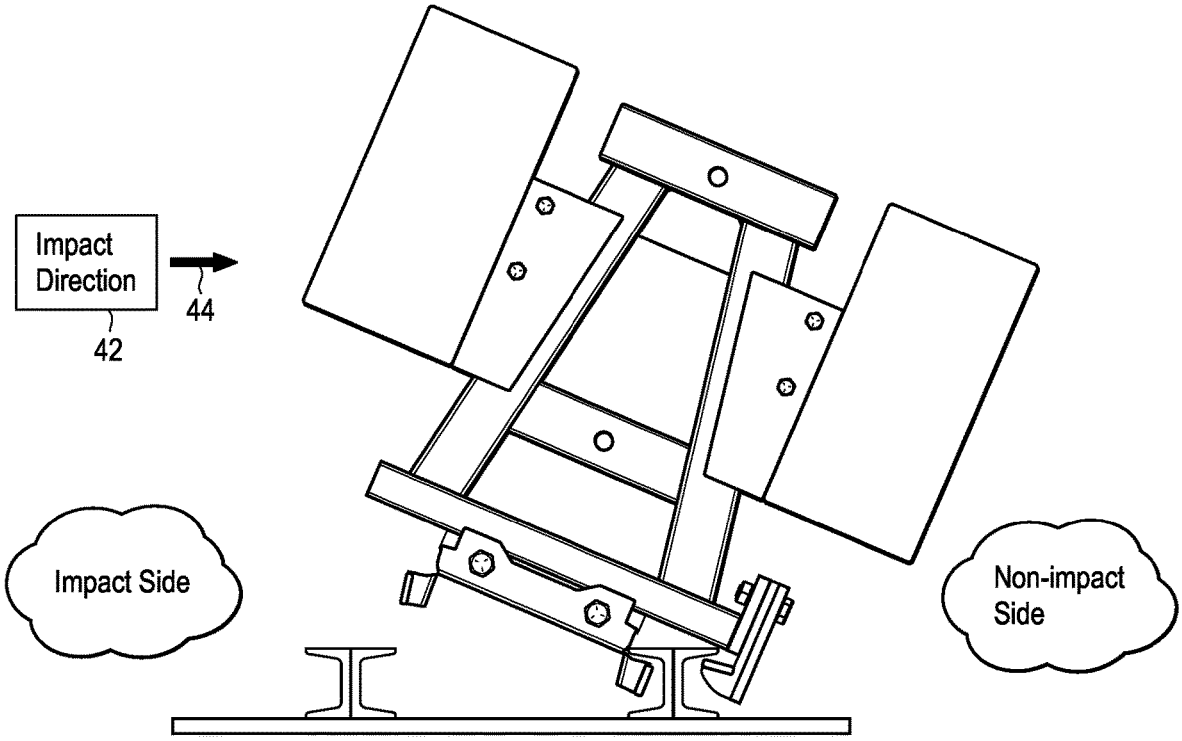
FIG. 8 is an end view of the diaphragm frame shown in FIG. 1 applied to a pair of rails during a lateral impact applying more than a third load configuration to the side of the crash cushion.
Figure 9:
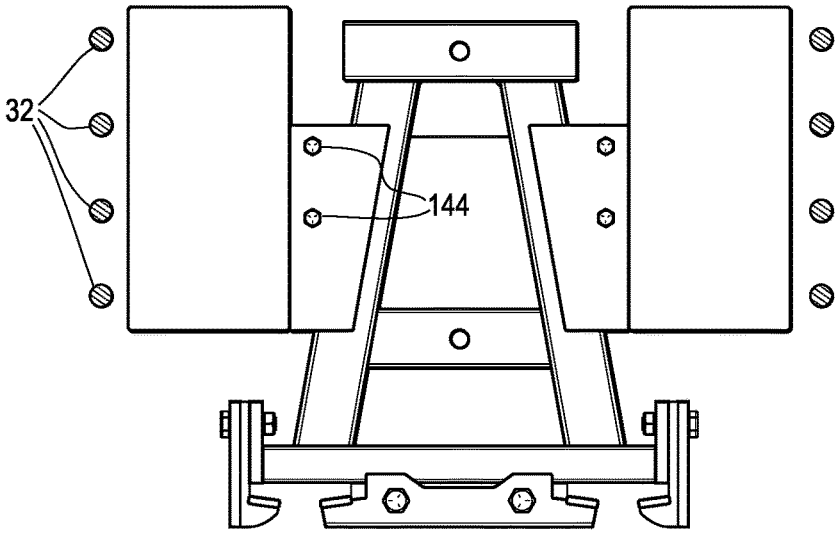
FIG. 9 is an end view of a diaphragm frame with a plurality of cables disposed along the side of the flexible panels.

If the impact load exceeds a third level of severity, for example when a third load configuration is applied to the impact side of the crash cushion, the inner guide 130 on the non-impact side, and in particular the end portion 141, may deform, for example by bending or fracture, thereby releasing the inner guide 130 on the non-impact side from the non-impact rail, and overhang 64, resulting in additional rotation of the diaphragm frame as shown in FIG. 8. In this last stage, the diaphragm frame 26 is disengaged from the base track, including the impact and non-impact side rails 30. The inner rail guide may be completely severed or separated from the diaphragm, or may merely deform such that the inner portion of the rail on the non-impact side is released. It should be understood that the inner guide 130 may also be configured to release upon failure of one or more fasteners securing the inner guide to the diaphragm.

It should be understood that during an impact event, the impact vehicle 42 will likely impact a plurality of tubes 12, with various loads being transferred from the tubes to corresponding ones of the diaphragm frames 26 to which they are attached, with each diaphragm frame undergoing the failure sequence described above if the impact loads surpass the predetermined load configuration for each failure sequence. It should be understood that some of the diaphragm frames 26 may experience all three load configurations, while others may experience different load configurations (e.g., first or second), and/or may not experience any failure of the outer and/or inner guides during the same impact event. After the impact event, the diaphragm frames 26 may be inspected and repaired as necessary, for example by replacing the fastener 116, outer guide 110 and/or inner guide(s) 130 (or bracket 132).

Overall, one embodiment of a method of attenuating energy when impacting a crash cushion includes laterally impacting a side of one or more energy absorbing members with a vehicle, wherein the one or more energy absorbing members are coupled to the diaphragm frame supported by first and second laterally spaced and longitudinally extending rails, transferring an impact load to the diaphragm frame from the one or more energy absorbing member, engaging an outboard portion of the first rail with a first outer guide, releasing the first rail from the first outer guide in response to a first load configuration applied to the side of the one or more energy absorbing members when laterally impacting the side of the one or more energy absorbing members, engaging an inboard portion of the first rail with a first inner guide spaced laterally inboard from the first outer guide, releasing the first rail from the first inner guide in response to a second load configuration applied to the side of the one or more energy absorbing members when laterally impacting the side of the one or more energy absorbing members, engaging an inboard portion of the second rail with a second inner guide spaced laterally from the first inner guide, and releasing the second rail from the second inner guide in response to a third load configuration applied to the side of the one or more energy absorbing members when laterally impacting the side of the one or more energy absorbing members.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A crash cushion comprising:

first and second laterally spaced and longitudinally extending rails;

a diaphragm frame comprising first and second laterally spaced sides, wherein the diaphragm frame is moveably supported by the first and second rails in a longitudinal direction;

first and second laterally spaced outer guides coupled to the diaphragm frame, each of the first and second outer guides configured to engage an outboard portion of the first and second rails respectively during a lateral impact of the crash cushion on a first or second side of the crash cushion respectively, wherein each of the first and second outer guides is releasable from the outboard portion of the first and second rails in response to a first load configuration applied to one of the first or second sides of the crash cushion respectively;

first and second laterally spaced inner guides coupled to the diaphragm frame, wherein the first and second inner guides are spaced laterally inboard from the first and second outer guides respectively, wherein the first inner guide is configured to engage an inboard portion of the first rail during the lateral impact of the crash cushion on the first side of the crash cushion after release of the first outer guide, wherein the first inner guide is releasable from the inboard portion of the first rail in response to a second load configuration applied to the first side of the crash cushion, wherein the second inner guide is configured to engage an inboard portion of the second rail during the lateral impact of the crash cushion on the first side of the crash cushion after release of the first inner guide, and wherein the second inner guide is releasable from the inboard portion of the second rail in response to a third load configuration applied to the first side of the crash cushion.

2. The crash cushion of claim 1 wherein the first and second outer guides are releasably coupled to the diaphragm frame with first and second fasteners respectively.

3. The crash cushion of claim 2 wherein the first and second outer guides each comprise an engagement portion underlying first and second outboard overhangs extending outboard from the first and second rails respectively.

4. The crash cushion of claim 3 wherein the first and second inner guides comprise a deformable engagement portion underlying first and second inboard overhangs extending inboard from the first and second rails respectively.

5. The crash cushion of claim 4 wherein the first and second rails each comprise one of an I-beam or a pair of back-to-back C channels.

6. The crash cushion of claim 1 wherein the first and second inner guides are defined at least in part by laterally spaced end portions of a bracket coupled to the diaphragm frame.

7. The crash cushion of claim 1 further comprising a first deformable cylinder coupled to an upstream face of the diaphragm frame.

8. The crash cushion of claim 7 further comprising a second deformable cylinder coupled to a downstream face of the diaphragm frame.

9. The crash cushion of claim 8 further comprising first and second flexible panels coupled to the first and second sides of the diaphragm frame respectively, wherein the first and second flexible panels extend laterally outwardly from the first and second sides of the diaphragm frame between the first and second deformable cylinders, wherein the first and second flexible panels are deformable in the longitudinal direction.

10. The crash cushion of claim 1 further comprising a plurality of the diaphragm frames spaced apart in the longitudinal direction, and a plurality of deformable energy absorbing elements, each of the deformable energy absorbing elements disposed between adjacent pairs of the diaphragm frames.

11. A crash cushion comprising:

first and second laterally spaced and longitudinally extending rails;

a diaphragm frame comprising first and second laterally spaced sides, wherein the diaphragm frame is moveably supported by the first and second rails in a longitudinal direction;

first and second laterally spaced outer guides coupled to the diaphragm frame, each of the first and second outer guides configured to engage an outboard portion of the first and second rails respectively during a lateral impact of the crash cushion on a first or second side of the crash cushion respectively, wherein each of the first and second outer guides is releasable from the outboard portion of the first and second rails in response to a first load configuration applied to one of the first or second sides of the crash cushion respectively;

first and second laterally spaced inner guides coupled to the diaphragm frame, wherein the first and second inner guides are spaced laterally inboard from the first and second outer guides respectively, wherein the first inner guide is configured to engage an inboard portion of the first rail during the lateral impact of the crash cushion on the first side of the crash cushion after release of the first outer guide, wherein the first inner guide is releasable from the inboard portion of the first rail in response to a second load configuration applied to the first side of the crash cushion, wherein the second inner guide is configured to engage an inboard portion of the second rail during the lateral impact of the crash cushion on the first side of the crash cushion after release of the first inner guide, and wherein the second inner guide is releasable from the inboard portion of the second rail in response to a third load configuration applied to the first side of the crash cushion;

a first deformable cylinder coupled to an upstream face of the diaphragm frame;

a second deformable cylinder coupled to a downstream face of the diaphragm frame; and a backup, wherein the second deformable cylinder is moveably connected to the backup, and wherein the second deformable cylinder is laterally moveable relative to the backup in response to the lateral impact of the crash cushion on the first side of the crash cushion.

12. The crash cushion of claim 11 wherein the backup comprises a laterally extending slot and further comprising a fastener extending from the second deformable cylinder, wherein the fastener is slidable within the slot in response to the lateral impact of the crash cushion on the first side of the crash cushion.

13. A crash cushion comprising:

a pair of laterally spaced and longitudinally extending rails, each of the rails comprising inboard and outboard overhangs extending laterally inboard and outboard respectively from each of the rails;

a diaphragm frame comprising laterally spaced sides, an upstream face and a downstream face, wherein the diaphragm frame is moveably supported by the rails, and wherein the diaphragm frame is moveable along the rails in a longitudinal direction;

an energy absorbing member coupled to the downstream face of the diaphragm frame;

a pair of laterally spaced outer guides coupled to the diaphragm frame, each of the outer guides comprising an engagement portion underlying the outboard overhang of one of the rails; and a pair of laterally spaced inner guides coupled to the diaphragm frame, each of the inner guides comprising an engagement portion underlying the inboard overhang of one of the rails, wherein the engagement portions of the inner guides are each deformable in response to a load applied thereby by the inboard overhang during an impact event such that the inner guides are released from the rails during the impact event.

14. A crash cushion comprising:

a pair of laterally spaced and longitudinally extending rails, each of the rails comprising inboard and outboard overhangs extending laterally inboard and outboard respectively from each of the rails;

a diaphragm frame comprising laterally spaced sides, an upstream face and a downstream face, wherein the diaphragm frame is moveably supported by the rails, and wherein the diaphragm frame is moveable along the rails in a longitudinal direction;

an energy absorbing member coupled to the downstream face of the diaphragm frame;

a pair of laterally spaced outer guides coupled to the diaphragm frame, each of the outer guides comprising an engagement portion underlying the outboard overhang of one of the rails, wherein the outer guides are each releasably coupled to the diaphragm frame with at least one fastener respectively, wherein at least one of the outer guides is releasable from the outboard overhang of the one of the rails during an impact event in response to a load configuration applied to one of a first or second side of the crash cushion respectively during the impact event; and a pair of laterally spaced inner guides coupled to the diaphragm frame, each of the inner guides comprising an engagement portion underlying the inboard overhang of one of the rails.

15. The crash cushion of claim 13 wherein each of the rails comprise one of an I-beam or back-back C-channels.

16. The crash cushion of claim 13 wherein the inner guides are defined by laterally spaced end portions of a bracket coupled to the diaphragm frame.

17. The crash cushion of claim 13 wherein the energy absorbing member comprises a deformable cylinder.

18. The crash cushion of claim 17 further comprising a second deformable cylinder coupled to the upstream face of the diaphragm frame.

19. The crash cushion of claim 13 further comprising a pair of flexible panels coupled to the sides of the diaphragm frame respectively, wherein the flexible panels extend laterally outwardly from the sides of the diaphragm frame and are deformable in the longitudinal direction.

20. The crash cushion of claim 13 further comprising a plurality of the diaphragm frames spaced apart in the longitudinal direction, and a plurality of the deformable energy absorbing elements, each of the deformable energy absorbing elements disposed between adjacent pairs of the diaphragm frames.

21. A crash cushion comprising:

a pair of laterally spaced and longitudinally extending rails, each of the rails comprising inboard and outboard overhangs extending laterally inboard and outboard respectively from each of the rails;

a diaphragm frame comprising laterally spaced sides, an upstream face and a downstream face, wherein the diaphragm frame is moveably supported by the rails, and wherein the diaphragm frame is moveable along the rails in a longitudinal direction;

an energy absorbing member coupled to the downstream face of the diaphragm frame;

a pair of laterally spaced outer guides coupled to the diaphragm frame, each of the outer guides comprising an engagement portion underlying the outboard overhang of one of the rails; and a pair of laterally spaced inner guides coupled to the diaphragm frame, each of the inner guides comprising an engagement portion underlying the inboard overhang of one of the rails; and a backup, wherein the energy absorbing member is moveably connected to the backup, and wherein the energy absorbing member is laterally moveable relative to the backup in response to a lateral impact of the crash cushion.

22. The crash cushion of claim 21 wherein the backup comprises a laterally extending slot and further comprising a fastener extending from the energy absorbing member, wherein the fastener is slidable within the slot in response to the lateral impact of the crash cushion.

* * * * *